US005409110A

United States Patent [19]

Patent

[11] Patent Number: 5,409,110

[45] Date of Patent: Apr. 25, 1995

[54] RAILWAY PART PALLET

[75] Inventor: Lowell Patent, Des Moines, Iowa

[73] Assignee: Patent's Railroad Packaging, Ltd., Windsor Heights, Iowa

[21] Appl. No.: 204,010

[22] Filed: Mar. 1, 1994

[51] Int. Cl.[6] ..... B65D 19/02

[52] U.S. Cl. ..... 206/335; 206/386; 206/511; 206/804; 53/248; 53/473

[58] Field of Search ..... 53/473, 474, 235, 255, 53/248; 206/335, 386, 446, 503, 509, 511, 521, 804

[56] References Cited

U.S. PATENT DOCUMENTS 4,389,832 6/1983 Calvert ..... 53/248 X
4,537,304 8/1985 Kaim et al. ..... 206/335
4,601,393 7/1986 Veenman et al. ..... 206/511 X
4,664,283 5/1987 Liu ..... 206/509 X

*Primary Examiner*—Jacob K. Ackun
*Attorney, Agent, or Firm*—Brian J. Laurenzo; Kent A. Herink; Brett J. Trout

[57] ABSTRACT

A method and apparatus for storing mechanical railway parts within individual cradles for transportation and storage. The cradles are designed to securely store and protect fragile parts while allowing for easy manipulation and recognition of the parts positioned within the cradles. Additionally, the cradles may be stacked to allow a greater number of mechanical railway parts to be shipped or stored in a given amount of space. The cradles transfer forces around the mechanical railway parts to prevent external forces from damaging the mechanical railway parts

23 Claims, 4 Drawing Sheets

RAILWAY PART PALLET

BACKGROUND OF THE INVENTION

The present invention relates generally to a method and apparatus for storing and transporting mechanical railway parts and, more particularly, to a method and apparatus for stacking such parts which allows the parts to be stored and transported in close proximity to one another without coming into contact with one another.

Many parts for railway cars are not only massive, but also are generally constructed of metal, which poses problems when parts contact each other during transportation and storage. Very often, when such contact occurs, the parts sustain sufficient damage to render them useless. Such parts must be discarded. As these parts are often very costly, it is desirable to prevent any such contact between parts. A further deterrent to allowing parts to contact during transportation and storage are industry standards prohibiting the storing of certain parts in contact with one another or on top of one another.

Large railway parts are often stored and transported by placing the parts on standard wooden pallets and releasably affixing the parts to the pallets with steel bands or the like. Loading and securing large railway parts can often take up to one hour for each part being loaded. Some parts, such as gears, have extremely delicate portions which must be protected with special packing. This packing is expensive and time consuming to apply and often cannot fully protect the part from damage. The unique shape of various parts prevents a standard method of transportation and storage.

The loading of parts such as gears typically involves rolling with the gear by foot across the ground and onto the forks of a forklift. The forklift then lifts the gear onto a pallet where it is strapped down. If the part is not damaged by being rolled along the ground or by being lifted by the metal forks of the forklift, the part still may be damaged during transport if another metallic part on the same pallet shifts into contact with, and thereby scratches or otherwise damages the part. This method of storing and transporting large mechanical railway parts also poses a problem of access to the part. All of the labor required to secure the part must be undone to obtain access to the part, making quick and easy access to the part virtually impossible.

Another difficulty with conventional storage and transportation methods is the large amount of space required to store and transport mechanical railway parts. The large amount of packing required between the parts, to keep them from contacting one another, prevents more than two large parts from being transported on a single pallet. Additionally, due to industry guidelines, the parts cannot be stacked on top of one another. Even if packing was provided between stacked parts, the sheer weight of the parts themselves would pose a significant risk of damage to the lower part.

Placement of the mechanical railway parts in form-fitting crates would be most advantageous for storage and transport of parts, but the absence of an easy way to insert parts into the crates and remove parts from the crates has heretofore prevented the use of such form-fitting crates. Indeed, it has heretofore been extremely difficult to remove large railway parts even from standardized crates. Standardized crates have the additional problem of insecure engagement with the parts which leads to a high risk of damage to either the part or the crate. These difficulties are reflected by is the industry's use of time consuming and bulky method of storing and transporting the parts on wooden pallets over use of either type of crate.

The difficulties encountered heretofore are substantially eliminated by the present invention.

Accordingly, an object of the invention is to provide a method for storing and transporting mechanical railway parts which allows easy access to the parts. The speed and ease with which parts may inserted into and withdrawn from the cradle of the present invention assures quick and easy access to the parts.

A further object of this invention is to provide a method for transporting mechanical railway parts in close proximity with one another without contact with one another. The close proximity of parts allows many more parts to be stored and transported in a given area.

Yet another object of the present invention is to provide a method for stacking mechanical railway parts above one another without subjecting the lower part to the weight of the upper part. Stacking allows many more parts to be stored and transported in a given area.

Another object of the present invention is to provide a cradle which protects delicate portions of mechanical railway parts. Since the cradle secures various portions of the part, the parts are prevented from contacting one another and causing damage to delicate portions of the parts.

Still another object of the present invention is to provide a stackable cradle for mechanical railway parts which is easy to lift and stack. Ribs within the cradle provide for safe and easy stacking, while fork holes provided on the bottom of the cradle allow the cradle to be easily captured and transported.

An additional object of the present invention is to provide a method for easily inserting a mechanical railway part within a cradle for storage or transport and for withdrawing the part from the cradle for use. The use of a lift strap provides allows the part to be inserted and withdrawn safely and easily.

Another object of the present invention is to provide a method for locking a lifting device within a mechanical railway part cradle to prevent its inadvertant removal. Wedging the lift strap between a mechanical railway part and the cradle assures ready access to the strap by preventing the strap from falling off or being stolen.

Yet a further object of the present invention is to provide a cradle for mechanical railway parts which is capable of securing various sized parts securely during transport and storage. The interior design of the cradle accommodates both large and small railway parts and secures the parts against longitudinal displacement and contact with other parts during storage and transportation.

Other objects of the invention include visual inspection of mechanical railway parts within stacked cradles and drainage of moisture out of the cradles to prevent rusting of the parts.

These and other objects of the invention will become apparent upon reference to the following specification, drawings and claims.

SUMMARY OF THE INVENTION

The present invention comprises a method for storing and transporting mechanical railway parts which allows ready access to the parts while preventing contact between the parts.

A part cradle is provided having a protective outer sidewall, a floor, and a vertical support having a head. A mechanical railway part is also provided, and a part lift strap is placed around the mechanical railway part so that the mechanical railway part may be lifted above the part cradle with the part lift strap. The mechanical railway part is placed within the protective outer sidewall of the part cradle, thereby securing the part lift strap between the mechanical railway part and the floor of the part cradle, to prevent the inadvertent removal of the part lift strap from the mechanical railway part.

In the preferred embodiment, a second cradle, having a protective outer sidewall, a floor, and a vertical support having a foot, is also provided, as is a second mechanical railway part and a second lift strap to lift the second railway part. The second railway part is lifted above the second cradle with the second lift strap. The second railway part is placed within the protective outer sidewall of the second cradle, thereby securing the second lift strap between the second railway part and the floor of the second cradle, to prevent the inadvertent removal of the second lift strap from the second mechanical railway part. The second cradle is lifted above the first cradle and stacked atop the first cradle by releasably engaging the foot of the vertical support of the second cradle to the head of the vertical support of the first cradle. This releasable engagement prevents the inadvertent removal of the second cradle from the first cradle.

Preferably, the mechanical railway part is a gear having a delicate chrome shaft and a durable body by which the gear is lifted. The cradle is provided with a deep forward portion and a shallow rearward portion to allow greater protection of the delicate chrome shaft, while allowing access to the durable body. The vertical supports consist of a series of ribs having interior seats which releasably engage and securely support the body of the gear within the cradle. The ribs are specially designed with interlocking feet and heads so that the cradle may be securely engaged to another, similar cradle, with force transmitted through the ribs instead of through the protective outer side wall. The cradle is also provided with fork holes so that the cradle may be easily engaged and lifted with a standard forklift.

DETAILED DESCRIPTION OF THE DRAWINGS

Figures 1, 2:
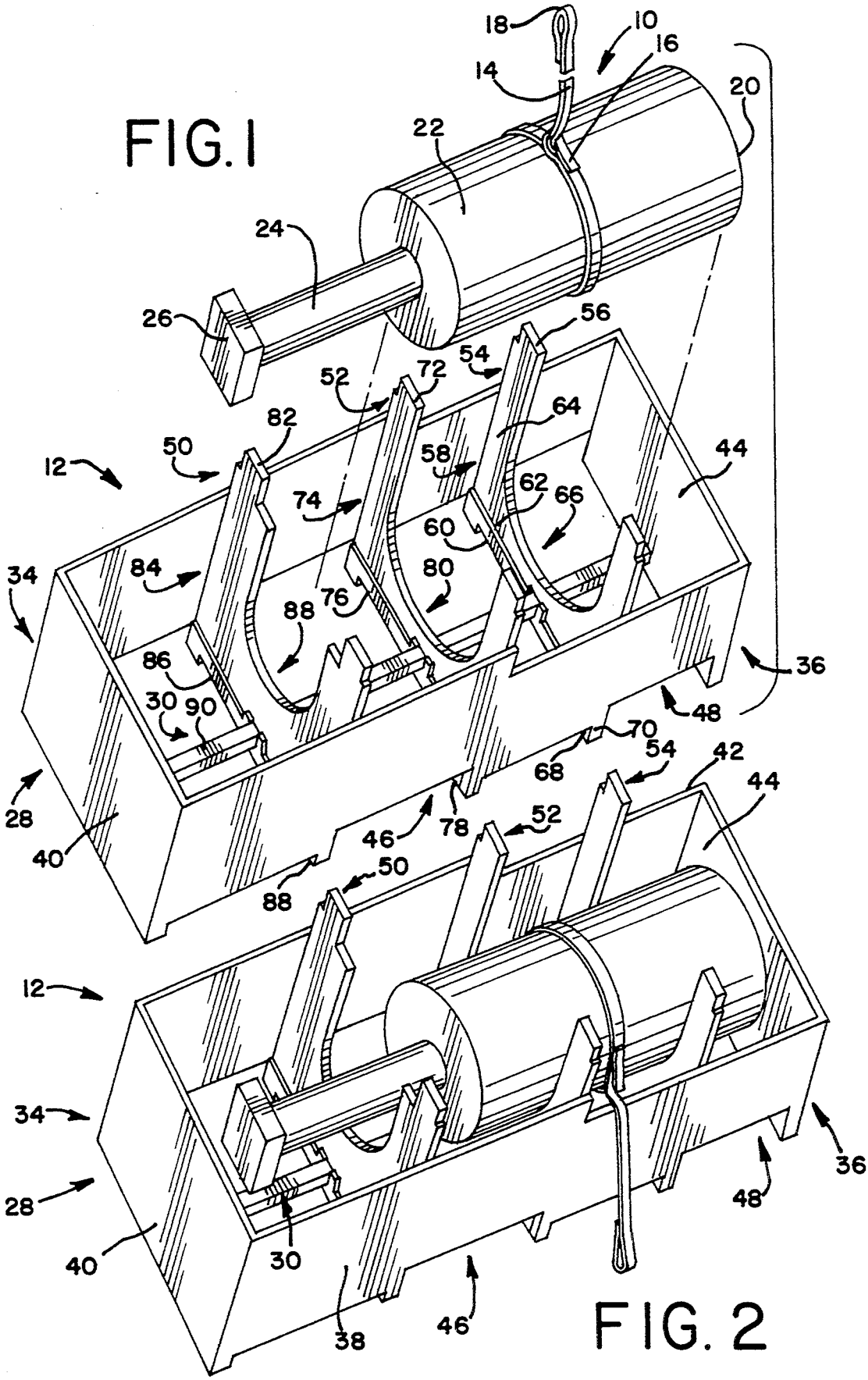
FIG. 1 is a perspective view of a mechanical railway part being lowered by a lift strap into a cradle of the present invention.
FIG. 2 is a perspective view showing the mechanical railway part within the cradle of the present invention and the lift strap extending from the side of the cradle.

While this invention is susceptible of embodiment in many different forms, there is shown in the drawings and will herein be described in detail, specific embodiments with the understanding that the present disclosure is to be considered as an exemplification of the principles of the invention and is not intended to limit the invention to the embodiments illustrated.

There is shown in FIG. 1 a large mechanical railway part known as a gear 10. The gear 10 is used as a shock absorber between railroad carriages (not shown). Gears come in many different shapes and sizes, often weighing from 750 to 1250 pounds and costing $1,500 to $3,500 apiece. The gear 10 is provided with a base 20, a large cylindrical body 22, a chrome shaft 24 slidably connected to the body 22, and an end block 26. Although different gears may have different types of bodies, ranging from round to rounded to even square cross-sections, the shafts are typically cylindrical. The chrome shaft 24 allows the gear 10 to operate more efficiently, but is extremely delicate, requiring extreme caution when handling. The delicate nature of the chrome shaft 24, combined with the bulk of the body 22 makes handling and transporting the gear 10 extremely unwieldy.

As shown in FIG. 1, the gear 10 is suspended above a transportation and storage cradle 12 by a lift strap 14 provided around the body 22 of the gear 10. The lift strap 14 is preferably constructed of a flat piece of woven nylon to allow the lift strap 14 to lie flat against the circumference of the gear 10 and to prevent the lift strap 14 from sliding longitudinally along the gear 10. The lift strap 14 is preferably provided with a securement loop 16 on one end and a lift loop 18 on the opposite end.

The cradle 12 is preferably of a one-piece construction, injection molded of high strength plastic (FIG. 2). The cradle 12 has three main sections: an exterior shell 28; a floor 30; and ribs 50, 52, and 54. As shown in FIG. 2, the shell 28 is only slightly larger than the gear 10 to allow lightweight compact storage of the gear 10. Despite the compact nature of the cradle 12, the shell 28 protects the gear 10 and prevents contact of the gear 10 with nearby gears or other parts (not shown).

The shell 28 has a deep forward portion 34 and a shallow rearward portion 36 (FIG. 2). The deep forward portion 34 has a pair of front sides 38 and a front end 40. The front sides 38 and 40 are preferably of a height sufficient to protect the chrome shaft 24 of the gear 10 from side and front impact damage. In the preferred embodiment the front sides 38 and 40 do not extend above or below the ribs 50, 52, and 54 which prevents the front sides 38 and end 40 from being damaged by external weight placed on the or in the cradle 12.

The shallow rearward portion 36 has a pair of rear sides 42 and a rear end 44. Unlike the front sides 38 and a front end 40 of the deep forward portion 34, the rear sides 42 and rear end 44 expose much of the gear 10. Preferably, the rear side 42 and rear end 44 cover only half the height of the cradle 12 to leave the upper half of the body 22 of the gear 10 exposed when the body 22 is placed within the cradle 12. This exposure facilitates access to the gear 10 when the gear 10 is placed within the cradle 12.

The shell 28 is provided with two sets of fork holes 46 and 48 to allow the cradle 12 to be lifted and transported by a forklift. The front fork holes 46 are provided in the lower rear portion of the deep forward portion 34 of the shell 28 while the rear fork holes 48 are provided in the lower rear of the shallow rearward portion 36 of the shell 28. The fork holes 46 and 48 are preferably not centered on the cradle 12, but instead centered under the center of gravity of the cradle 12 and gear 10 assembly. Accordingly, the fork holes 46 and 48 are provided closer to the rear end of 44 of the cradle 12, centered more under the body 22 of the gear 10 than under the cradle 12, since the body 22 is significantly heavier than the chrome shaft 24.

The three ribs 50, 52, and 54 interconnect the sides 38 and 42 of the shell 28 and divide the cradle 12 into four sections of substantially equal area (FIG. 2). The front rib 50 is centered within the deep forward portion 34 of the shell 28, while the rear rib 54 is centered within the shallow rearward portion 36 of the shell 28. The center rib 52 is provided in the center of the shell 28 between the deep forward portion 34 and the shallow rearward portion 36.

The rear rib 54 has a head 56, a body 58 and a foot 60 (FIG. 1). The body 58 has a base 62 extending between the sides 42 of the shallow rearward portion 36 of the shell 28. From the base 62 the body 58 extends upward into two arms 64 forming an interior seat 66. The ends of the arms 64 form the head 56 of the rear rib 54. The interior seat 66 is formed with a semi-circular curve of a diameter substantially equal to the diameter of the body 22 of the gear 10.

Figure 3:
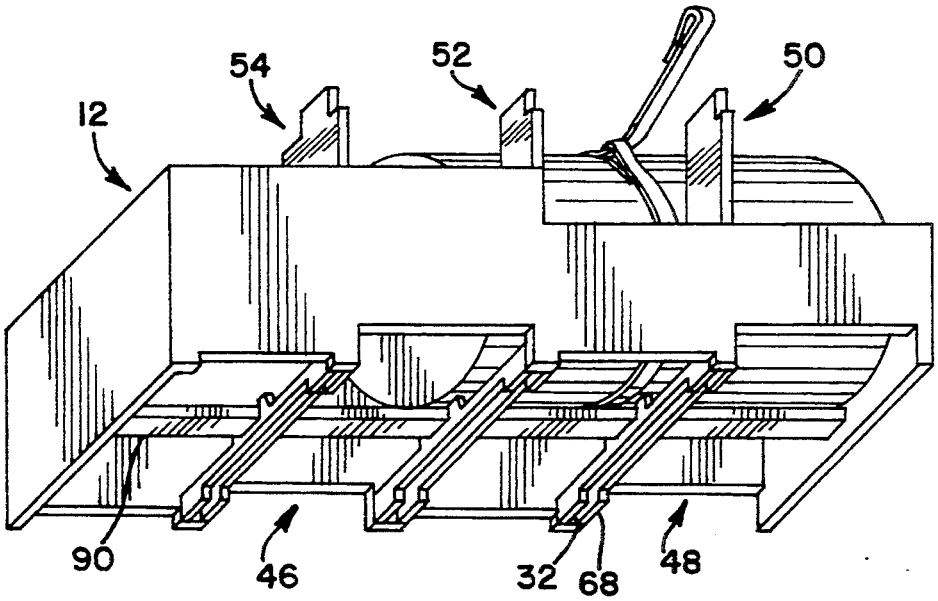
FIG. 3 is an underside perspective view of the mechanical railway part positioned within the cradle of the present invention.

The foot 60 of the rear rib 54 is thicker than the base 62 of the body 58 to accommodate an interior groove 67 (FIGS. 1 and 3). The interior groove 67 is preferably as wide and long as the front rib 82 to allow a front rib of a similar cradle to be releasably engaged within the interior groove 67 when the cradle 12 is stacked. Two downward projections 68 extend from the foot 60, below both sides 42 of the shallow rearward portion 36 of the shell 28. Two fingers 70 extend downward from the shell 28, closing off the interior groove 67 and providing the downward projections 68 with sides. The fingers 70 are contiguous with the shell 28 and extend to the lowermost portion of the downward projections 68.

The center rib 52 is also provided with a head 72, a body 74, and a foot 76 having downward projections 78 (FIG. 1). The center rib 52 is also provided with a semi-circular interior seat 80 of a diameter equal to the diameter of the body 22 of the gear 10. The center rib 52, however, is connected to both the deep forward portion 34 and the shallow rearward portion 36 of the shell 28.

The front rib 50 interconnects the sides 38 of the deep forward portion 34 of the shell 28 (FIG. 1). The front rib 50 is provided with a head 82, a body 84, and a foot 86 having downward projections 88 similar to the center rib 52 and rear rib 54. The front rib 50 is provided with a narrow interior 89, making the interior of the cradle 12 asymmetric. The narrow interior 89 forces the gear 10 to be loaded with the body 22 positioned within the shallow rearward portion 36 of the shell 28 and the chrome shaft 24 positioned within the deep forward portion 34 of the shell 28. This required positioning of the gear 10 within the cradle 12 prevents the cradle 12 from becoming unbalanced when lifted with forks positioned within the fork holes 46 and 48, and assures that the chrome shaft 24 is adequately protected. Unlike the interior seats 66 and 80 of the rear rib 54 and center rib 52, the narrow interior 88 of the front rib 50 does not contact the gear 10 when the gear 10 is seated within the cradle 12. Contact of the chrome shaft 24 with any solid object, even the cradle 12 could be enough to damage the chrome shaft 24. Accordingly, unlike the two wide interior seats 66 and 80, the narrow interior seat 88 does not contact the chrome shaft 24 of the gear 10, but rather passes forces through the cradle and around the chrome shaft 24. Although FIG. 1 depicts ribs 50, 52, and 54 having semi-circular interiors, it should be noted that the interiors may be rounded or even square to accommodate specific shapes of gears.

Figure 4:
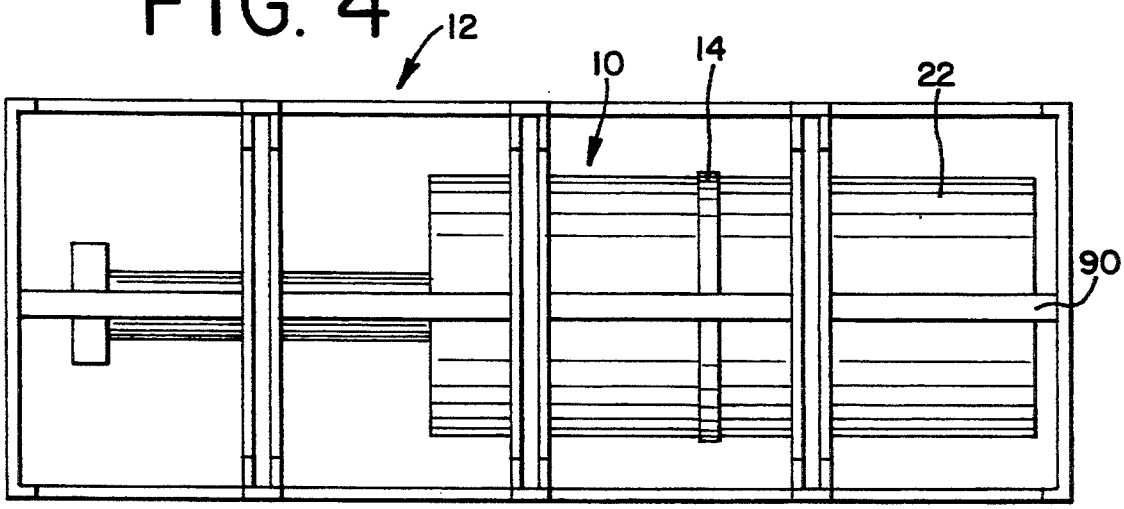
FIG. 4 is a bottom elevational view of the mechanical railway part positioned within the cradle of the present invention, showing the lift strap wedged between the floor and the mechanical railway part.

Running the length of the floor 30 of the cradle 12 is a joist 90 (FIG. 4). The use of a single joist 90 allows water from rain or condensation to drain out the cradle, instead of building up next to the gear 10 where rust and corrosion are likely to occur. This "flow-through" also prevents trapped water from adding unnecessary, weight the cradle 12. In the preferred embodiment of the present invention the floor 30 is provided with only a single joist 90 to allow maximum water flow-through and minimum weight. It should be noted, however, that the floor 30 may be provided with a plurality of joists interconnecting the sides of the shell 28. It is advantageous, however, to provide some type of passage through the floor 30 to allow water to escape from the cradle 12 instead of being retained against the gear 10.

The joist 90 interconnects all three ribs 50, 52 and 54 with the front end 40 and rear end 44 of the shell 28 (FIG. 1). The joist 90 is provided high enough above the lowermost portion of the cradle 12 to allow forklift forks entering the fork holes 46 and 48 of the shell 28 to reach under the joist 90 to lift the cradle 12. The joist 90 is also placed close enough to the interior seats 66 and 80 of the ribs 54 and 52 to trap the lift strap 14 between the gear 10 and the joist 90 when the gear 10 is placed within the cradle 12.

To load the gear 10 into the cradle 12, the lift strap 14 is wrapped around the body 22 of gear 10 near the center of gravity of the gear 10 (FIG. 1). The lift loop 18 is then passed through the securement loop 16 and pulled to draw the lift strap 14 tightly around the gear. The lift loop 18 is then connected to forks of a forklift (not shown). The gear 10 is lifted with the lift strap 14 and centered above the cradle 12. The gear 10 is then lowered into the cradle 12 so that the body 22 of the gear 10 rests within the interior seat 66 of the rear rib 54 and the interior seat 80 of the center rib 52. In this position, the chrome shaft 24 of the gear 10 is positioned within the interior 89 of the front rib 50, but does not touch the front rib 50.

Once the gear 10 has been lowered into the cradle 12, the lift strap 14 is thereby wedged between the body 22 of the gear 10 and the joist 90 by the weight of the gear 10 (FIG. 4). This prevents the lift strap 14 from being removed from the gear 10 while the gear is resting within the cradle 12. By preventing the removal of the lift strap 14, the difficulties of locating another strap and providing the strap around the gear 10 while the gear 10 is within the cradle 12 are eliminated. Additionally, since the lift strap 14 cannot be removed from the gear 10 while in the gear 10 is in the cradle 12, the potential for theft of the lift strap is virtually eliminated. Once the gear 10 has been placed within the cradle 12, a forklift (not shown) slides its forks within the fork holes 46 and 48 of the cradle 12 and the cradle 12 is lifted to be loaded for either transportation or storage (FIG. 3).

Figure 5:
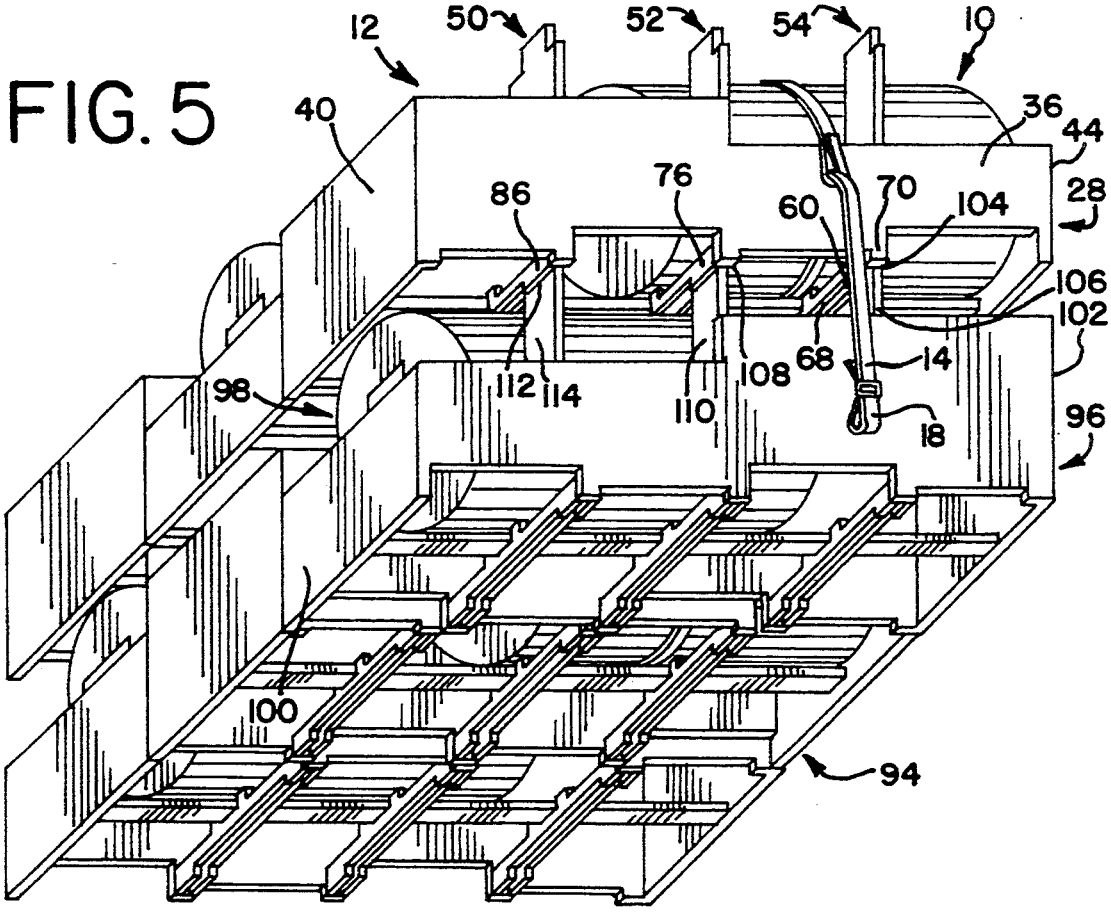
FIG. 5 is a perspective view showing a plurality of stacked cradles.

The gear 10 and the cradle 12 may be stacked for transportation or storage as shown in FIG. 5. Under present industry standards, the gear 10 and the cradle 12 may be stacked two high for transportation and four high for storage. To stack the cradle 12, a second cradle 96 is loaded with a second gear 98 the second cradle 96 is loaded by a second lift strap 94, in a manner similar to that described above. Once the additional cradle 96 has been loaded, the second lift strap 94 is drawn over the additional cradle 96 to provide easy access to the second lift strap 94 after stacking. The cradle 12 is then lifted above the second cradle 96 and centered above the second cradle 96 with the front end 40 of the cradle 12 over a rear end 100 of the second cradle 96 and the rear end 44 of the cradle 12 over a front end 102 of the second cradle 96. The cradle 12 is then lowered onto the second cradle 96 so that the foot 60 of the rear rib 54 of the cradle 12 engages a head 104 of a front rib 106 of the second cradle 96.

The low profile of the shallow rearward portion 36 of the shell 28 allows visual inspection of the gear 10 and access to the lift strap 14 even when the cradles 12 and 96 are stacked (FIG. 5). The downward projections 68 of the cradle 12 prevent the cradle 12 from moving longitudinally relative to the second cradle 96. Similarly, the fingers 70 prevent the cradle 12 from moving laterally relative to the second cradle 96. The foot 76 of the center rib 52 and the foot 86 of the rear rib 54 on the cradle 12 are engaged to a head 108 of a center rib 110 and a head 112 of a rear rib 114 on the second cradle 96. Once the cradle 12 has been placed on the second cradle 96, the lift strap 14 is pulled over the shallow rearward portion 36 of the shell 28 to provide easy access to the lift strap 14. Yet another cradle (not shown) may also be stacked on top of the cradle 12 depending on rules and regulations regarding transport of specific mechanical railway parts. The gear 10 may thereby be loaded above another gear 98 without danger of either of the gears 10 and 98 contacting one another or being subjected to the weight of one another.

The unique design of the cradle 12 allows force from a cradle or similar item stacked on top of the cradle 12 to be transferred directly from the heads 56, 72, and 82 of the ribs 54, 52 and 50 through the bodies 58, 74 and 84 and directly onto the feet 60, 76 and 86 (FIG. 1). This direct transfer of force prevents the shell 28 and gear 10 from being subjected to a potentially damaging downward force and allows lighter weight and less expensive material to be used for the shell 28.

The interior seats 66 and 80 of the rear rib 54 and center rib 52 transfer the downward force of the gear 10 through the joist 90 and onto the feet 60, 76 and 86 of all three ribs 54, 52, and 50. The ribs 54, 52, and 50 also transfer the force of the gear 10 through the cradle 12. The weight of the gear 10 is thereby prevented from damaging either the shell 28 or the gear 10.

Figure 6:
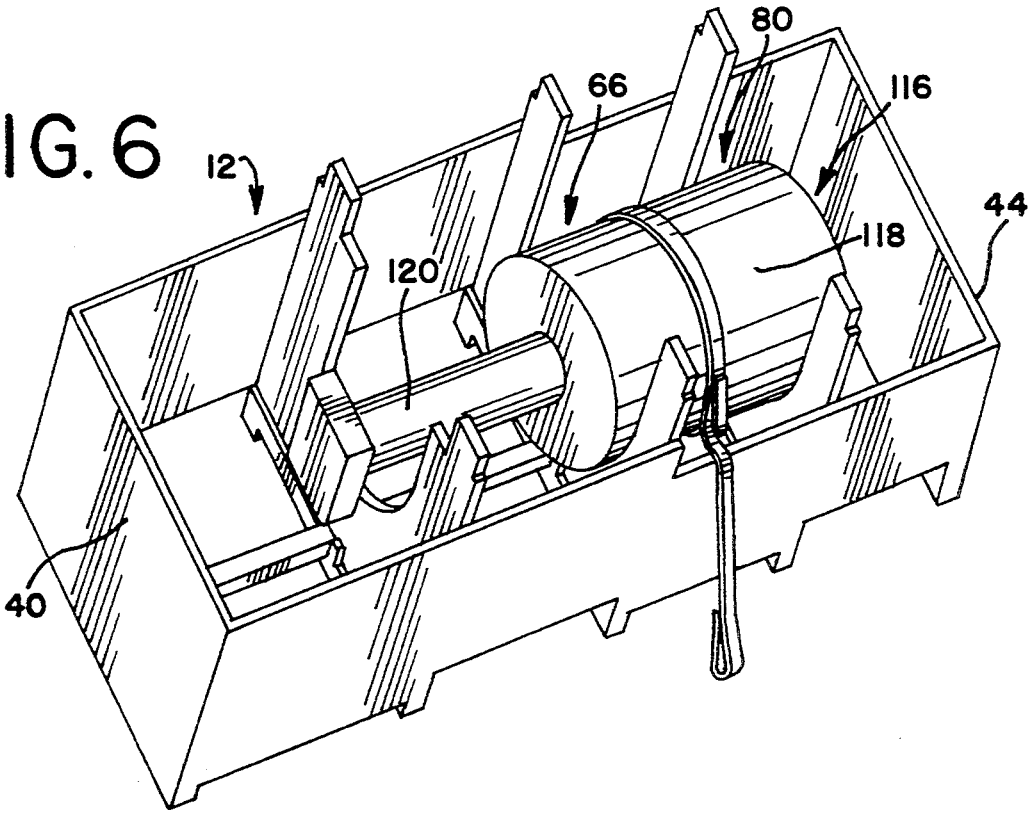
FIG. 6 is a perspective view of a smaller mechanical railway part placed within the cradle of the present invention.

FIG. 6 shows the cradle 12 of the present invention housing a smaller gear 116. Although the gear 116 is smaller than the standard gear 10, the cradle 12 works equally well for storage and transport of this smaller gear 116 (FIGS. 1 and 6). When loading the cradle 12 with a smaller gear 116, however, the smaller gear 116 is centered within the cradle 12 so that a body 118 of the gear 116 rests within the interior seats 66 and 80 of the rear rib 54 and center rib 52, while a chrome shaft of the gear 116 rests within the interior seat 88 of the front rib 50 without touching the front rib 50. The smaller gear 116 may be held in place by its own weight or additional packing (not shown) may be placed at the front end 40 and rear end 44 of the cradle 12 to prevent shifting of the smaller gear 116 toward either the front end 40 or rear end 44 of the cradle 12 during storage and transport.

Figure 7:
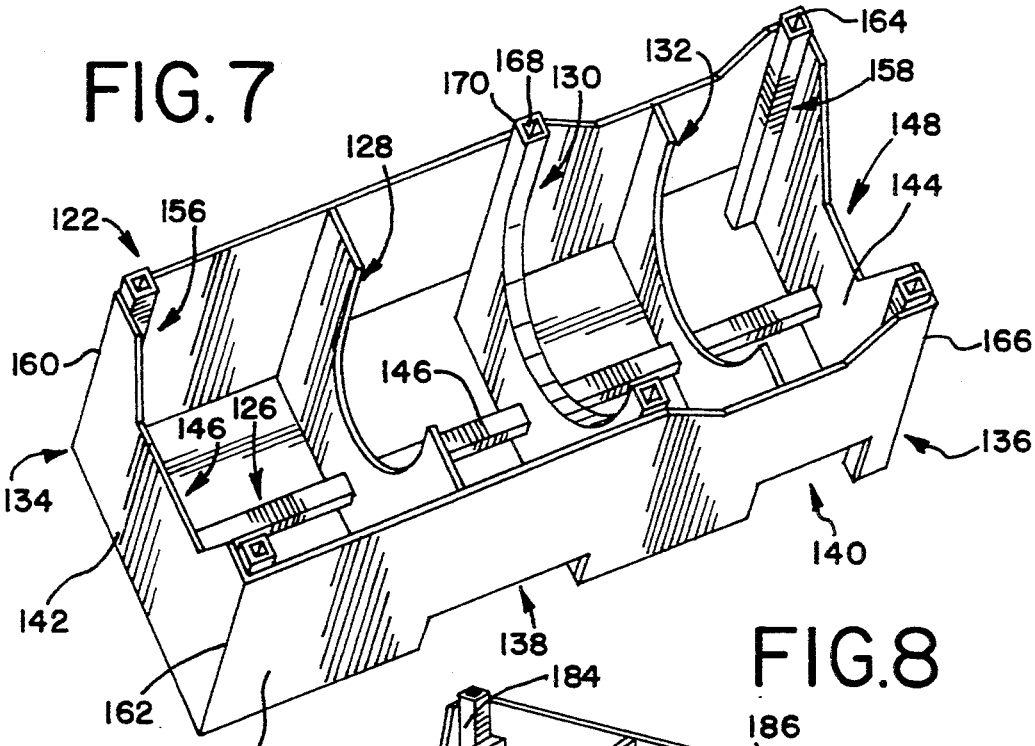
FIG. 7 is a perspective view of an alternative embodiment of the present invention.

FIG. 7 shows an alternative embodiment of the present invention. A cradle 122 is shown having an exterior shell 124, a floor 126, and three ribs 128, 130, and 132. The shell 124 has a deep forward portion 134 that slopes into a shallow rearward portion 136. Both portions 134 and 136 of the shell 124 extend to the bottom of the cradle 122 to foil any attempt to place forklift forks anywhere but within a pair of offset fork holes 138 and 140 provided in the shell 124. The fork holes 138 and 140 allow the cradle 122 to be easily captured and safely transported by a standard forklift. The shell 124 is provided with a front 142 and a rear 144, both of which are provided with cutaway portions. The cutaway portions are provided to decrease the weight of the cradle 122 while increasing visibility and access to a gear 150 placed within the cradle 122 (FIGS. 7 and 8).

Figure 9:
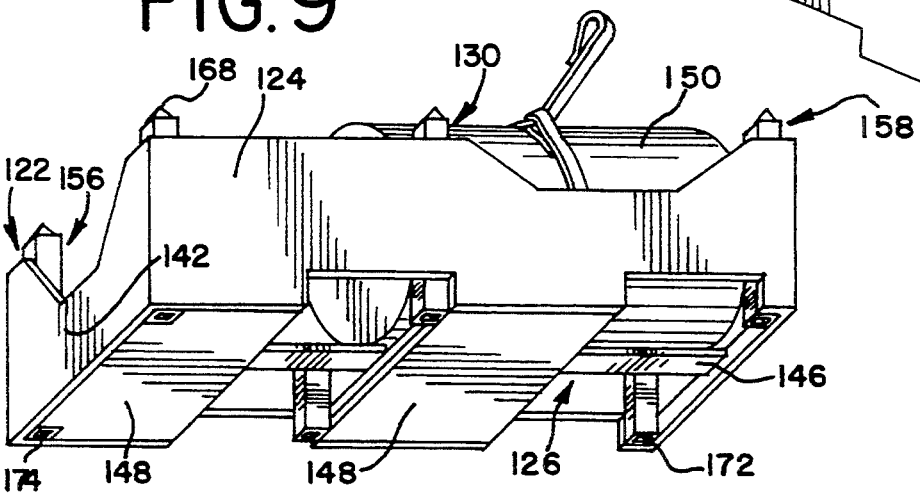
FIG. 9 is an underside perspective view of the alternative embodiment of FIG. 7, shown with a mechanical railway part placed therein.

As shown in FIG. 9, the floor 26 comprises not only a floor joist 146, but also a pair of support panels 148. The support panels 148 interconnect the bottom of the shell 124 across the center and front of the cradle 122. The support panels 148 lend stability to the cradle 122 and prevent the shell 124 from bowing inward when struck with forklift forks or similar external forces.

Figure 8:
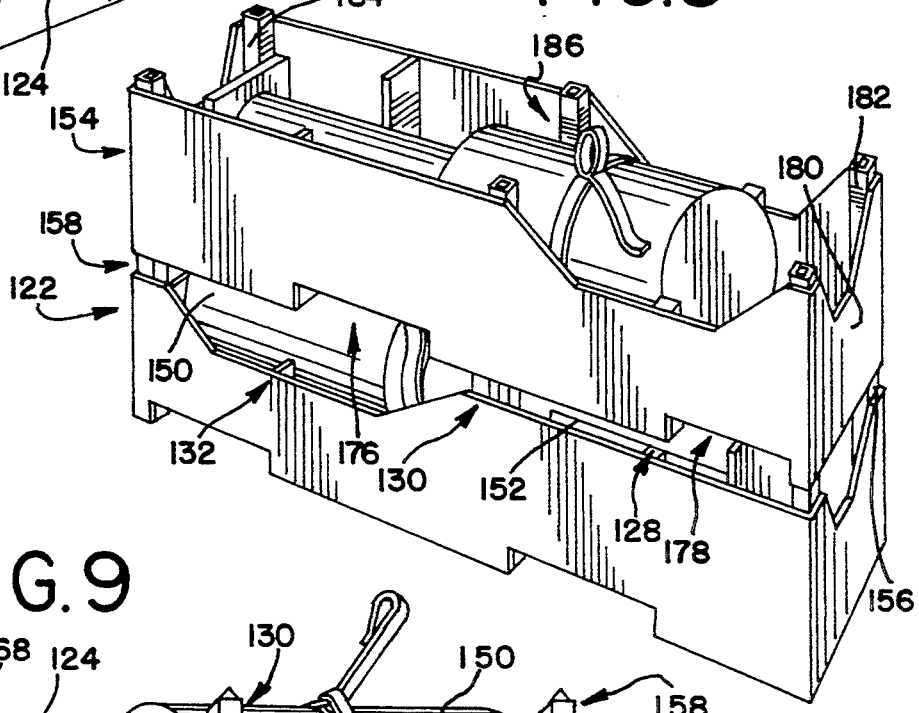
FIG. 8 is a perspective view showing two crates of the alternative embodiment stacked together.

Like the preferred embodiment of the invention, only the center rib 130, and rear rib 132, of the embodiment shown in FIG. 7 contact the gear 150 placed within the cradle 122 (FIGS. 7 and 8). Similarly, a front rib 128 surrounds and protects, but does not contact a chrome shaft 152 provided on the gear 150. Unlike the preferred embodiment, however, neither the rear rib 132 nor the front rib 128 transfer the weight of a stacked cradle 154 through the cradle 122. The front rib 128 is only as tall as the deep forward portion 134 and the rear rib 132 is only as tall as the shallow rearward portion 126, making both of the ribs 128 and 132 too short to shoulder the weight of the stacked cradle 154.

The weight of the stacked cradle 154 is instead transferred by the center rib 130 and two pairs of corner supports 156 and 158 (FIGS. 7 and 8). The corner supports 156 and 158 are solid plastic beams of a square cross-section and are molded as part of the one-piece cradle 122. The front pair of corner supports 156 are secured to corners 160 and 162 of the deep forward portion 134 of the shell 124 and the rear pair of corner supports 158 are secured to corners 164 and 166 of the shallow rearward portion 136 of the shell 124. The shell 124 slopes upward toward each pair of corner supports 156 and 158 to stabilize the corner supports 156 and 158 against lateral impact. The perimeter placement of the corner supports 156 and 158 allows the cradle 122 to support the stacked cradle 154 with greater stability. The perimeter placement also allows the corner supports 156 and 158 to be used as visible reference points for a forklift operator (not shown) when the stacked cradle 154 is placed on top of the cradle 122. Stacking is thereby made easier and quicker.

The corner supports 156 and 158 and the center rib 130 all extend slightly beyond the top of the shell 124 to protect the shell 124 from potentially damaging external downward forces (FIG. 7). Both the corner supports 156 and 158 and the center rib 130 are provided with pyramidal caps 168. The pyramidal caps 168 are molded as part of the corner supports 156 and 158 and the center rib 130 and cover an area slightly smaller than the tops of the corner supports 156 and 158 and the center rib 130. Ledges 170 are thereby formed between the pyramidal caps 168 and edges of the corner supports 156 and 158 and the center rib 130. The corner supports 156 and 158 and the center rib 130 are provided on their bottoms with matching pyramidal recesses 172 (FIGS. 7 and 9). The support panels 148 are provided with openings 174 to expose the pyramidal recesses 172 provided on the center rib 130 and the front pair of corner supports 156. The interior dimensions of the pyramidal recesses 172 are equal to the exterior dimensions of the pyramidal caps 168.

The cradles 122 and 154 are stacked in a manner similar to that described above for the cradle 12 of the preferred embodiment. Once the cradles 122 and 154 have been loaded, the stacked cradle 154 is captured by placing forklift forks within fork holes 176 and 178 provided in a shell 180 of the stacked cradle 154 (FIG. 8). The stacked cradle 154 is then lifted above the cradle 122 and lowered onto the cradle 122 so that the pyramidal caps 168 of the front pair of corner supports 156 on the cradle 122 engage pyramidal recesses (not shown) provided in the bottoms of a rear pair of corner supports 182 on the stacked cradle 154 (FIGS. 7 and 8). Similarly the pyramidal caps 168 of the rear pair of corner supports 158 on the cradle 122 engage pyramidal recesses (not shown) provided in the bottoms of a front pair of corner supports 184 on the stacked cradle 154. The pyramidal caps 168 of the center rib 130 on the cradle 122 also engage pyramidal recesses (not shown) provided in the bottom of a center rib 186 on the stacked cradle 154.

The pyramidal caps 168 of the cradle 122 and the pyramidal recesses of the stacked cradle 154 prevent the stacked cradle 154 from moving laterally relative to the cradle 122 (FIGS. 7 and 8). The ledges 170 on the corner supports 156 and 158 and the center rib 130 of the cradle 122 allow the pyramidal caps 168 to lock the cradles 122 and 154 together without damaging either cradle 122 or 154. The ledges 170 catch the supports panels (not shown) and the bottom of the rear corner supports 182 of the stacked cradle 154 to prevent the stacked cradle 154 from placing too much pressure on the tops of the pyramidal caps 168 and possibly damaging either the pyramidal caps 168 or the stacked cradle 154. The ledges 170 allow the weight of the stacked cradle 154 to be distributed more evenly, while still allowing the pyramidal caps 168 to perform their stabilizing function.

What is claimed is:

1. A method for storing and transporting mechanical railway parts which allows ready access to the mechanical railway parts and prevents contact between the mechanical railway parts during transport and storage, the method comprising:

(a) providing a mechanical railway part;

(b) providing a part cradle having a protective outer sidewall, a floor, and a vertical support having a head;

(c) placing a part lift strap around said mechanical railway part;

(d) lifting said mechanical railway part above said part cradle with said part lift strap; and (e) placing said mechanical railway part within said protective outer sidewall of said part cradle thereby securing said part lift strap between said mechanical railway part and said floor of said part cradle to prevent the inadvertent removal of said part lift strap from said mechanical railway part.

2. The method of claim 1, wherein said part cradle is provided with at least two fork holes which pass through said protective outer sidewall.

3. The method of claim 1, further comprising:

(a) providing a second mechanical railway part;

(b) providing a second cradle having a protective outer sidewall, a floor, and a vertical support having a foot;

(c) placing a second lift strap around said second mechanical railway part;

(d) lifting said second mechanical railway part above said second cradle with said second lift strap;

(e) placing said second mechanical railway part within said protective outer sidewall of said second cradle thereby securing said second lift strap between said second mechanical railway part and said floor of said second cradle to prevent the inadvertent removal of said second lift strap from said second mechanical railway part;

(f) lifting said second cradle above said part cradle; and (g) stacking said second cradle atop said part cradle by releasably engaging said foot of said vertical support of said second cradle to said head of said vertical support of said part cradle to prevent the inadvertent removal of said second cradle from said part cradle.

4. The method of claim 3, further comprising:

(a) providing said head of said vertical support of said part cradle with a pyramidal cap;

(b) providing said foot of said vertical support of said second cradle with a pyramidal recess; and (c) releasably engaging said pyramidal cap into said pyramidal recess.

5. A method for storing and transporting mechanical railway parts which allows ready access to the mechanical railway parts and prevents contact between the mechanical railway parts during transport and storage, the method comprising:

(a) providing a first mechanical railway part having a delicate forward portion and a heavier rearward portion;

(b) providing a first cradle comprising:

(i) a rectangular protective outer sidewall having a three-sided deep portion and a three-sided shallow portion;

(ii) a floor joist operably secured to said deep portion and to said shallow portion;

(iii) a rear rib having a head, a body, and a foot, said rear rib secured to and supported by said shallow portion and said floor joist in a manner which allows a force to be transferred from said head, through said body, across said floor joist, and onto said foot without being imparted onto said protective outer sidewall, said rear rib being provided with a wide seat for supporting said heavier rearward portion of said first mechanical railway part;

(iv) a center rib having a head, a body, and a foot, said center rib secured to and supported by said deep potion, said shallow portion and said floor joist, in a manner which allows a force to be transferred from said head, through said body, across said floor joist, and onto said foot without being imparted onto said protective outer sidewall, said center rib being provided with a wide seat for supporting said heavier rearward portion of said first mechanical railway part;

(v) a front rib having a head, a body, and a foot, said front rib secured to and supported by said deep portion and said floor joist in a manner which allows a force to be transferred from said head, through said body, across said floor joist, and onto said foot without being imparted onto said protective outer sidewall, said front rib being provided with an interior narrower than said wide seat of said rear rib;

(c) placing a first lifting strap around said first mechanical railway part;

(d) lifting said first mechanical railway part above said cradle;

(e) placing said delicate forward portion of said first mechanical railway part within said narrow interior of said front rib;

(f) placing said rearward portion of said first mechanical railway part within said wide seat of said center rib and within said wide seat of said rear rib so that the weight of said first mechanical railway part is supported by both said center rib and said rear rib;

(g) wedging said first lifting strap between said first mechanical railway part and said floor joist to prevent the inadvertent removal of said first lifting strap;

(h) providing a second mechanical railway part having a delicate forward portion and a heavier rearward portion;

(i) providing a second cradle comprising:

(i) a protective outer sidewall having a three-sided deep portion and a three-sided shallow portion;

(ii) a floor joist operably secured to said deep portion and to said shallow portion;

(iii) a rear rib having a head, a body, and a foot, said rear rib secured to and supported by said shallow portion and said floor joist in a manner which allows a force to be transferred from said head, through said body, across said floor joist, and onto said foot without being imparted onto said protective outer sidewall, said rear rib being provided with a wide seat for supporting said heavier rearward portion of said second mechanical railway part;

(iv) a center rib having a head, a body, and a foot, said center rib secured to and supported by said deep potion, said shallow portion and said floor joist, in a manner which allows a force to be transferred from said head, through said body, across said floor joist, and onto said foot without being imparted onto said protective outer sidewall, said center rib being provided with a wide seat for supporting said heavier rearward portion of said second mechanical railway part;

(v) a front rib having a head, a body, and a foot, said front rib secured to and supported by said deep portion and said floor joist in a manner which allows a force to be transferred from said head, through said body, across said floor joist, and onto said foot without being imparted onto said protective outer sidewall, said front rib being provided with an interior narrower than said wide seat of said rear rib;

(j) placing a second lifting strap around said second mechanical railway part;

(k) lifting said second mechanical railway part above said cradle;

(l) placing said delicate forward portion of said second mechanical railway part within said narrow interior of said front rib;

(m) placing said rearward portion of said second mechanical railway part between said wide seat of said center rib and said wide seat of said rear rib so that the weight of said second mechanical railway part is supported by said rear rib and said center rib of said second cradle;

(n) wedging said second lifting strap between said second mechanical railway part and said floor joist to prevent the inadvertent removal of said second lifting strap;

(o) placing one end of said second lifting strap over said shallow portion of said protective outer sidewall;

(p) lifting said second cradle above said first cradle;

(q) releasably securing said foot of said rear rib of said second cradle onto said head of said front rib of said first cradle;

(r) releasably securing said foot of said center rib of said second cradle to said head of said center rib of said first cradle; and (s) releasably securing said foot of said front rib of said second cradle to said head of said rear rib of said first cradle.

6. The method of claim 5, further comprising the step of transporting said second cradle on top of said first cradle.

7. The method of claim 5, wherein said first cradle is provided with at least two fork holes which pass through said protective outer sidewall of said first cradle.

8. The method of claim 5, further comprising:

(a) providing said head of said center rib of said first cradle with a pyramidal cap;

(b) providing said foot of said center rib of said second cradle with a pyramidal recess; and (c) releasably engaging said pyramidal cap into said pyramidal recess.

9. A method for storing and transporting mechanical railway parts which allows ready access to the mechanical railway parts and prevents contact between the mechanical railway parts during transport and storage, the method comprising:

(a) providing a first mechanical railway part having a delicate forward portion and a heavier rearward portion;

(b) providing a first cradle comprising:

(i) a protective outer sidewall having a three-sided deep portion having a front and a three-sided shallow portion having a rear;

(ii) a floor joist operably secured between said front and said rear of said protective outer sidewall;

(iii) a rear rib having a wide seat and a foot, said rear rib secured to and supported by said shallow portion and said floor joist in a manner which allows a force to be transferred from said wide seat to said foot without being imparted onto said protective outer sidewall, said wide seat being wide enough to support said heavier rearward portion of said first mechanical railway part;

(iv) a center rib having a head, a body, and a foot, said center rib secured to and supported by said deep portion, said shallow portion and said floor joist, in a manner which allows a force to be transferred from said head, through said body, across said floor joist, and onto said foot without being imparted onto said protective outer sidewall, said center rib being provided with a wide seat for supporting said heavier rearward portion of said first mechanical railway part;

(v) a front rib having a narrow interior and a foot, said front rib secured to and supported by said deep portion, said narrow interior being too narrow to accommodate said heavier rearward portion of said first mechanical railway part;

(vi) a first vertical support operably connected to said front of said protective outer sidewall, said first vertical support having a head and a foot;

(vii) a second vertical support operably connected to said rear of said protective outer sidewall, said second vertical support having a head and a foot;

(c) placing a first lifting strap around said first mechanical railway part;

(d) lifting said first mechanical railway part above said cradle;

(e) placing said delicate forward portion of said first mechanical railway part within said narrow interior of said front rib;

(f) placing said rearward portion of said first mechanical railway part within said wide seat of said center rib and within said wide seat of said rear rib so that the weight of said first mechanical railway part is supported by both said center rib and said rear rib;

(g) wedging said first lifting strap between said first mechanical railway part and said floor joist to prevent the inadvertent removal of said first lifting strap;

(h) providing a second mechanical railway part having a delicate forward portion and a heavier rearward portion;

(i) providing a second cradle comprising:

(j) providing a second cradle comprising:

(i) a protective outer sidewall having a three-sided deep portion having a front and a three-sided shallow portion having a rear;

(ii) a floor joist operably secured between said front and said rear of said protective outer sidewall;

(iii) a rear rib having a wide seat and a foot, said rear rib secured to and supported by said shallow portion and said floor joist in a manner which allows a force to be transferred from said wide seat to said foot without being imparted onto said protective outer sidewall, said wide seat being wide enough to support said heavier rearward portion of said second mechanical railway part;

(iv) a center rib having a head, a body, and a foot, said center rib secured to and supported by said deep portion, said shallow portion and said floor joist, in a manner which allows a force to be transferred from said head, through said body, across said floor joist, and onto said foot without being imparted onto said protective outer sidewall, said center rib being provided with a wide seat for supporting said heavier rearward portion of said second mechanical railway part;

(v) a front rib having a narrow interior and a foot, said front rib secured to and supported by said deep portion, said narrow interior being too narrow to accommodate said heavier rearward portion of said second mechanical railway part;

(vi) a first vertical support operably connected to said front of said protective outer sidewall, said first vertical support having a head and a foot;

(vii) a second vertical support operably connected to said rear of said protective outer sidewall, said second vertical support having a head and a foot;

(j) placing a second lifting strap around said second mechanical railway part;

(k) lifting said second mechanical railway part above said cradle;

(l) placing said delicate forward portion of said second mechanical railway part within said narrow interior of said front rib;

(m) placing said rearward portion of said second mechanical railway part between said wide seat of said center rib and said wide seat of said rear rib so that the weight of said second mechanical railway part is supported by said rear rib and said center rib of said second cradle;

(n) wedging said second lifting strap between said second mechanical railway part and said floor joist to prevent the inadvertent removal of said second lifting strap;

(o) placing one end of said second lifting strap over said shallow portion of said protective outer sidewall;

(p) lifting said second cradle above said first cradle;

(q) releasably securing said foot of said first vertical support of said second cradle onto said head of said second vertical support of said first cradle;

(r) releasably securing said foot of said center rib of said second cradle to said head of said center rib of said first cradle; and (s) releasably securing said foot of said second vertical support front rib of said second cradle to said head of said first vertical support of said first cradle.

10. The method of claim 9, further comprising the step of transporting said second cradle on top of said first cradle.

11. The method of claim 9, wherein said first cradle is provided with at least two fork holes which pass through said protective outer sidewall of said first cradle.

12. The method of claim 9, further comprising:

(a) providing said head of said center rib of said first cradle with a pyramidal cap;

(b) providing said foot of said center rib of said second cradle with a pyramidal recess;

(c) releasably engaging said pyramidal cap of said center rib of said first cradle into said pyramidal recess of said center rib of said second cradle;

(d) providing said head of said first vertical support of said first cradle with a pyramidal cap;

(e) providing said foot of said second vertical support of said second cradle with a pyramidal recess;

(f) releasably engaging said pyramidal cap of said first vertical support of said first cradle into said pyramidal recess of said second vertical support of said second cradle;

(g) providing said head of said second vertical support of said first cradle with a pyramidal cap;

(h) providing said foot of said first vertical support of said second cradle with a pyramidal recess; and (i) releasably engaging said pyramidal cap of said second vertical support of said first cradle into said pyramidal recess of said first vertical support of said second cradle.

13. A cradle for storing and transporting a mechanical railway part in a manner which allows ready access to the mechanical railway part while preventing damage to the mechanical railway part during transport and storage, said cradle comprising:

(a) a protective outer sidewall;

(b) a floor operably connected to said protective outer sidewall;

(c) means provided in said floor for draining liquid from said floor;

(d) support means operably connected to said protective outer sidewall and to said floor for transferring a downward force of an object placed within the cradle through said floor without imparting said downward force onto said protective outer sidewall and without imparting said downward force onto said floor;

(f) means operably connected to said protective outer sidewall and said floor for directly transferring an external force across said protective outer sidewall and through said floor without imparting said external force onto said protective outer sidewall and without imparting said external force onto said floor; and (g) stacking means operably connected to said protective outer sidewall and said floor for stacking the cradle on another, similar cradle without imparting a downward force of the cradle onto a protective outer sidewall of said similar cradle and without imparting said downward force of the cradle onto a floor of said similar cradle.

14. The cradle of claim 13, wherein said protective outer shell is provided with at least two fork holes which pass through said protective outer sidewall of said first cradle.

15. The cradle of claim 13, further comprising:

(a) a mechanical railway part provided within said protective outer sidewall; and (b) a lift strap provided around said mechanical railway part wherein said lift strap is wedged between said mechanical railway and said floor sufficiently tightly to prevent inadvertent removal of said strap until said mechanical railway part is removed from said cradle.

16. A cradle assembly for storing and transporting a mechanical railway part in a manner which allows ready access to the mechanical railway part while preventing damage to the mechanical railway part during transport and storage, said cradle assembly comprising:

(a) a protective outer sidewall;

(b) a floor joist operably secured to said protective outer sidewall;

(c) a first rib secured to said protective outer sidewall and having a head, a foot, and a support seat;

(d) a second rib secured to said protective outer sidewall and having a head, a foot, and a support seat;

(e) a mechanical railway part provided within said protective outer sidewall, said mechanical railway part having a first portion and a second portion, wherein said first portion is supported by said seat of said first rib and said second portion is supported by said seat of said second rib;

(f) a lift strap provided around said mechanical railway part and wherein said lift strap is wedged between said mechanical railway and said floor joist sufficiently tightly to prevent inadvertent removal of said strap until said mechanical railway part is removed from said cradle; and (g) a plurality of head engagers secured to said foot of said first rib and said foot of said second rib to allow said cradle to be stacked upon another, similar cradle.

17. The cradle assembly of claim 16, wherein said cradle is provided with at least two fork holes which pass through said protective outer sidewall.

18. The cradle assembly of claim 16, further comprising:

(a) a pyramidal cap operably connected to said head of said first rib;

(b) a pyramidal cap operably connected to said head of said second rib;

(c) means operably connected to said foot of said first rib for releasably engaging a pyramidal cap; and (d) means operably connected to said foot of said second rib for releasably engaging a pyramidal cap.

19. A cradle assembly for storing and transporting mechanical railway parts in a manner which allows ready access to the mechanical railway parts while preventing contact between the mechanical railway parts during transport and storage, said cradle assembly comprising:

(a) a first mechanical railway part;

(b) a first cradle comprising:

(i) a protective outer sidewall;

(ii) a floor operably connected to said protective outer sidewall (iii) means provided in said floor for draining liquid from said floor;

(iv) a first rib having a head, a body, and a foot, said first rib operably secured to and supported by said protective outer sidewall and said floor in a manner which allows a force to be transferred from said head, through said body, across said floor, and onto said foot without being imparted onto said protective outer sidewall and without being imparted onto said floor, said first rib also being provided with an interior seat having sides and a bottom which secure said first mechanical railway part against inadvertent downward and transverse movement of said first mechanical railway part relative to said seat during transport and storage of said first mechanical railway part, said first rib also having an open top allowing unobstructed insertion and removal of said first mechanical railway part, said first rib being of a construction so as to pass the downward force of said first mechanical railway part through said floor and into said foot without imparting said downward force onto said protective outer sidewall;

(c) a second mechanical railway part;

(d) a second cradle comprising:

(i) a protective outer sidewall provided around said second mechanical part;

(ii) a floor operably connected to said protective outer sidewall, said floor adding rigidity to said protective outer sidewall while allowing liquid to pass out of said protective outer sidewall through said floor;

(iii) means provided in said floor for draining liquid from said floor;

(iv) a second rib having a head, a body, and a foot, said second rib operably secured to and supported by said protective outer sidewall and said floor in a manner which allows a force to be transferred from said head, through said body, across said floor, and onto said foot without being imparted onto said protective outer sidewall, said second rib being provided with an interior seat having sides and a bottom which secure said second mechanical railway part against inadvertent downward and transverse movement of said second mechanical railway part relative to said seat during transport and storage of said second mechanical railway part, said second rib also having an open top allowing unobstructed insertion and removal of said second mechanical railway part, said second rib being of a construction so as to pass the downward force of said second mechanical railway part through said floor and into said foot without imparting said downward force onto said protective outer sidewall and without imparting said downward force onto said floor;

(e) engagement means operably connected to said foot of said first rib for releasably engaging said head of said second rib; and (f) wherein said foot of said first rib is releasably engaged with said head of said second rib.

20. The cradle assembly of claim 19, further comprising:

(a) a pyramidal cap operably connected to said head of said second rib;

(b) means operably connected to said foot of said first rib for releasably engaging a pyramidal cap; and (c) wherein said pyramidal cap of said head said second rib is releasably engaged with said releasable engaging means of said foot of said first rib.

21. A cradle assembly for storing and transporting a mechanical railway part in a manner which allows ready access to the mechanical railway part while preventing damage to the mechanical railway part during transport and storage, said cradle assembly comprising:

(a) a first cradle comprising:

(i) a protective outer sidewall having a three-sided deep portion and a three-sided shallow portion;

(ii) a floor joist operably secured to said deep portion and to said shallow portion;

(iii) a rear rib having a wide seat and a foot, said rear rib secured to and supported by said shallow portion and said floor joist in a manner which allows a force to be transferred from said wide seat to said foot without being imparted onto said protective outer sidewall, said wide seat being wide enough to support said heavier rearward portion of said first mechanical railway part;

(iv) a center rib having a head, a body, and a foot, said center rib secured to and supported by said deep portion, said shallow portion and said floor joist, in a manner which allows a force to be transferred from said head, through said body, across said floor joist, and onto said foot without being imparted onto said protective outer sidewall, said center rib being provided with a wide seat for supporting said heavier rearward portion of said first mechanical railway part;

(v) a front rib having a narrow interior and a foot, said front rib secured to and supported by said deep portion, said narrow interior being too narrow to accommodate said heavier rearward portion of said first mechanical railway part;

(vi) a first vertical support operably connected to said front of said protective outer sidewall, said first vertical support having a head and a foot;

(vii) a second vertical support operably connected to said rear of said protective outer sidewall, said second vertical support having a head and a foot;

(b) a first mechanical railway part provided within said protective outer sidewall of said first cradle, said first mechanical railway part having a narrow first end, a wide center portion, and a wide second end, wherein said first end is positioned within and unsupported by said interior of said front rib of said first cradle, said second end is supported by said seat of said rear rib of said first cradle, and said center portion is supported by said seat of said center rib of said first cradle;

(c) a first lift strap provided around said first mechanical railway part, wherein said first lift strap is wedged between said first mechanical railway part and said floor joist sufficiently tightly to prevent inadvertent removal of said first lift strap until said first mechanical railway part is removed from said first cradle; and (d) a second cradle comprising:

(i) a protective outer sidewall having a three-sided deep portion and a three-sided shallow portion;

(ii) a floor joist operably secured to said deep portion and to said shallow portion;

(iii) a rear rib having a wide seat and a foot, said rear rib secured to and supported by said shallow portion and said floor joist in a manner which allows a force to be transferred from said wide seat to said foot without being imparted onto said protective outer sidewall, said wide seat being wide enough to support said heavier rearward portion of said second mechanical railway part;

(iv) a center rib having a head, a body, and a foot, said center rib secured to and supported by said deep portion, said shallow portion and said floor joist, in a manner which allows a force to be transferred from said head, through said body, across said floor joist, and onto said foot without being imparted onto said protective outer sidewall, said center rib being provided with a wide seat for supporting said heavier rearward portion of said second mechanical railway part;

(v) a front rib having a narrow interior and a foot, said front rib secured to and supported by said deep portion, said narrow interior being too narrow to accommodate said heavier rearward portion of said second mechanical railway part;

(vi) a first vertical support operably connected to said front of said protective outer sidewall, said first vertical support having a head and a foot;

(vii) a second vertical support operably connected to said rear of said protective outer sidewall, said second vertical support having a head and a foot;

(e) a second mechanical railway part provided within said protective outer sidewall of said second cradle, said second mechanical railway part having a narrow first end, a wide center portion, and a wide second end, wherein said first end is positioned within and unsupported by said interior of said front rib of said second cradle, said second end is supported by said seat of said rear rib of said second cradle, and said center portion is supported by said seat of said center rib of said second cradle;

(f) a second lift strap provided around said second mechanical railway part, wherein said second lift strap is wedged between said second mechanical railway part and said floor joist sufficiently tightly to prevent inadvertent removal of said second lift strap until said second mechanical railway part is removed from said second cradle; and (j) wherein said foot of said first vertical support of said second cradle is releasably engaged to said head of said second vertical support of said first cradle, said foot of said center rib of said second cradle is releasably engaged to said head of said center rib of said first cradle, and said foot of said first vertical support of said second cradle is releasably engaged to said head of said second vertical support of said first cradle.

22. The cradle assembly of claim 19, wherein said cradle is provided with at least two fork holes which pass through said protective outer sidewall.

23. The cradle assembly of claim 19, further comprising:

(a) a pyramidal cap provided on said head of said center rib of said first cradle;

(b) means operably connected to said foot of said center rib of said second cradle for releasably engaging said pyramidal cap provided on said head of said center rib of said first cradle;

(c) a pyramidal cap provided on said head of said first vertical support of said first cradle;

(d) means operably connected to said foot of said second vertical support of said second cradle for releasably engaging said pyramidal cap provided on said head of said first vertical support of said first cradle;

(e) a pyramidal cap provided on said head of said second vertical support of said first cradle; and (f) means operably connected to said foot of said first vertical support of said second cradle for releasably engaging said pyramidal cap provided on said head of said second vertical support of said first cradle.

* * * * *